US005651682A

United States Patent [19]

Blok et al.

[11] Patent Number: 5,651,682

[45] Date of Patent: Jul. 29, 1997

[54] STICKS AND METHOD FOR CONSULTING CHINESE BOOK OF CHANGES

[75] Inventors: Frits Johan Blok, Amsterdam; Wilhelmus Jacobus Marinus Zonjee, Hensbroek, both of Netherlands

[73] Assignee: Blozo Products V.O.F., Amsterdam, Netherlands

[21] Appl. No.: 550,820

[22] Filed: Oct. 31, 1995

[51] Int. Cl.[6] ..... G09B 25/00; A63F 9/04

[52] U.S. Cl. ..... 434/403; 273/161; 273/146

[58] Field of Search ..... 434/403; 273/161, 273/146, 143 A

[56] References Cited

U.S. PATENT DOCUMENTS

| | | | |
|---|---|---|---|
| 496,293 | 10/1990 | Griffith | 273/147 |
| 880,640 | 3/1908 | Emerson | 273/161 |
| 3,603,593 | 9/1971 | Chew | 273/161 |

OTHER PUBLICATIONS

Wilhelm et al, The I Ching, 1990, pp. 721–724, Prinston University Press.

Ritsema et al, I Ching, 1994, pp. 20–23, Barnes & Noble.

*Primary Examiner*—Jeffrey A. Smith

*Attorney, Agent, or Firm*—Keck, Mahin & Cate

[57] ABSTRACT

The present invention provides a method and device for consulting and contemplating the ancient Chinese Book of Changes. The invention provides six rectangular sticks having indicia on the four sides. Two of the indicia represents the changing Yang line and the Yin line and are located on two of the sides opposite from one another, and the other two indicia represent the changing Yin line and the Yang line and are located on the other two sides opposite from one another. The sticks are tossed in order to arrive at a first hexagram. In the event that there are any changing lines appearing in the first hexagram, the sticks having the changing lines are turned over to construct a second hexagram.

16 Claims, 3 Drawing Sheets

STICKS AND METHOD FOR CONSULTING CHINESE BOOK OF CHANGES

TECHNICAL FIELD

The present invention relates generally to a method and means of consulting the ancient Chinese Book of Changes, and more particularly to a method and means of constructing the Book of Changes hexagrams.

BACKGROUND ART

The I-Ching, or as it is commonly translated, the Book of Changes, is an ancient Chinese oracle book which can be consulted to obtain an insight to a question posed.

The Book of Changes includes 64 hexagrams each comprising a unique combination of six lines. The 64 hexagrams are followed by two texts which provide an explanation of the 64 hexagrams.

The Book of Changes is consulted and contemplated by first posing a specific question to which one seeks an insight and then by using one of two methods to construct by chance one of the 64 hexagrams. The text and commentaries are then consulted to interpret the particular hexagram as it relates to the posed question.

The oldest method in which to consult the Book of Changes consists of the manipulation of 50 yarrow stalks.

Another old yet more conventional method of consulting the Book of Changes comprises the tossing of three identical coins six times. Three coins are used since each of the six lines comprising a hexagram is based on a trigram having three lines. As shown in FIG. 1*a*–1*h*, there are eight trigrams 8 each comprising a unique combination of three solid and broken (interrupted) lines. The solid line represents the Yang force and the broken line represents the Yin force.

The coin toss method involves arbitrarily assigning either the Yin or Yang force to each side of the coins. The next step involves tossing the three coins to arrive at the first line.

The line is typically determined in the following manner. The side of the coin assigned the Yin force is also assigned the numeral value of 2. The side of the coin assigned the Yang force is also assigned the numeral value of 3. With each toss of the coins, the numeral value facing upward of each coin is added to arrive at a total value. A total value of 6 is equal to an old or changing Yin line, a total value of 7 is equal to a young or unchanging Yang line, a total value of 8 is equal to a young or unchanging Yin line and a total value of 9 is equal to an old or moving Yang line.

The first line provides the first line of the hexagram which is the bottom line of the hexagram. The three coins are tossed six times to arrive at the six lines of the hexagram. Each toss of the three coins will provide one line.

Typically, the line produced by the first toss is recorded as the first line of the hexagram. Similarly, after each toss of the coins, the resulting line is recorded as the next successive line of the hexagram. In this manner, the possibility of introducing error while constructing the hexagram is reduced.

FIG. 2 shows one of the 64 hexagrams 10 having lines 1–6. It can be seen from lines 1 and 5 that a young or unchanging Yin line is represented by the broken or Yin line. From lines 3 and 6 it can be seen that a young or unchanging Yang line is represented by the solid or Yang line. Line 2 shows that the changing Yin line is represented by a broken line with an "X" at the middle of the broken line. Line 4 shows that the changing Yang line is represented by a solid line with a circle at the middle of the line.

The hexagram produced by the six lines is then used to consult the Book of Changes.

In the event the hexagram includes changing lines, then the individual is referred to two hexagrams. The first hexagram is the one initially constructed. The Book of Changes is consulted with regard to the initial hexagram. The changing lines are considered at their zenith and are subject to change into the opposite lines. Therefore, in order to arrive at the second hexagram, each changing Yin line in the initial hexagram is changed to a Yang line and each changing Yang line in the initial hexagram is changed to Yin line. In this manner the second hexagram is constructed and the Book of Changes is consulted further.

A disadvantage of the foregoing methods is that they are cumbersome and time consuming in order to arrive at a hexagram.

SUMMARY OF THE INVENTION

It is an object of the invention to provide a method and apparatus which provides a convenient manner in which to consult the Book of Changes.

It is a further object of the invention to provide a convenient means and method of constructing by chance a hexagram for consulting the Book of Changes.

The present invention provides a device for consulting the Book of Changes, the device comprising, an object, the object having a first, second, third and fourth side, the first side having a first indicia, the second side having a second indicia, the third side having a third indicia and the fourth side having a fourth indicia, wherein two of the indicia represent the changing Yin line and the Yang line and are located on two of the sides opposite from one another, and the other two indicia represent the changing Yang and the Yin line and are located on the other two sides opposite one another.

The present invention also provides a method of consulting the Book of Changes, the method comprising the steps of, grasping 6 rectangular blocks each having four longitudinally extending sides with indicia, wherein two of the indicia represent the changing Yin lines and the Yang lines and are located on two of the sides opposite from one another, and the other two indicia represent the changing Yang line and the Yin line and are located on the other two sides opposite from one another, tossing the six objects so as to randomly align in a consecutive order, reading the indicia facing upwards so as to construct a hexagram, and consulting the Book of Changes for the constructed hexagram.

DETAILED DESCRIPTION OF THE INVENTION

Figure 1:
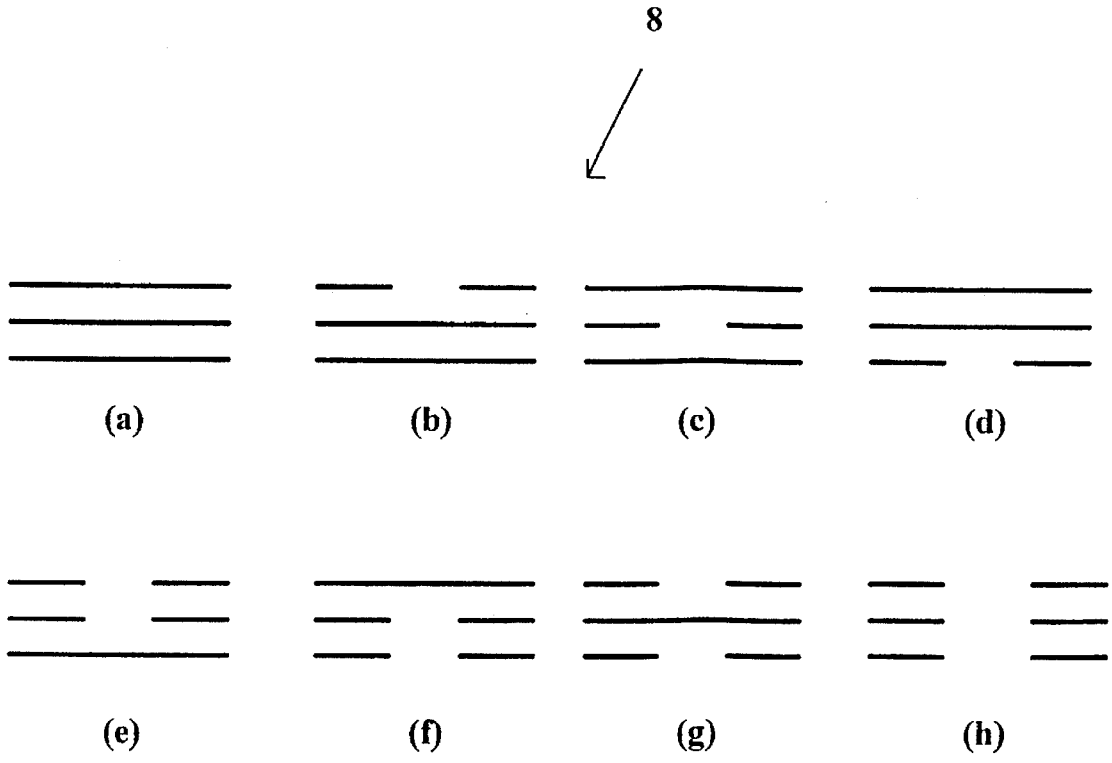
FIG. 1 depicts the 8 trigrams (a–h) of the Book of Changes.
Figure 2:
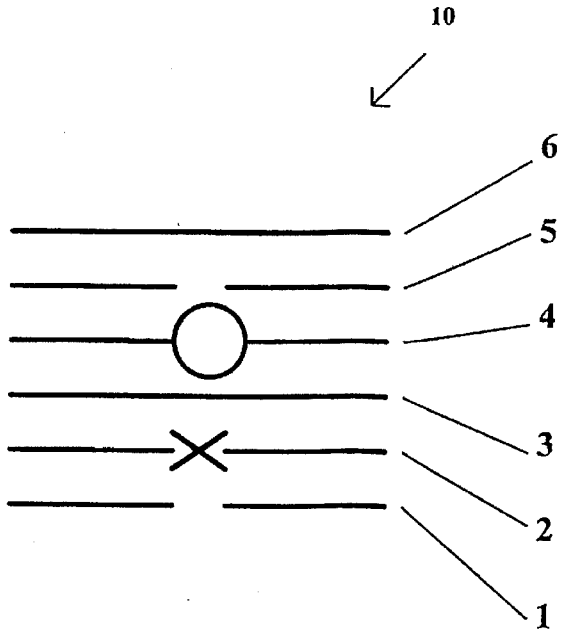
FIG. 2 depicts one of the 64 hexagrams of the Book of Changes.
Figure 3:
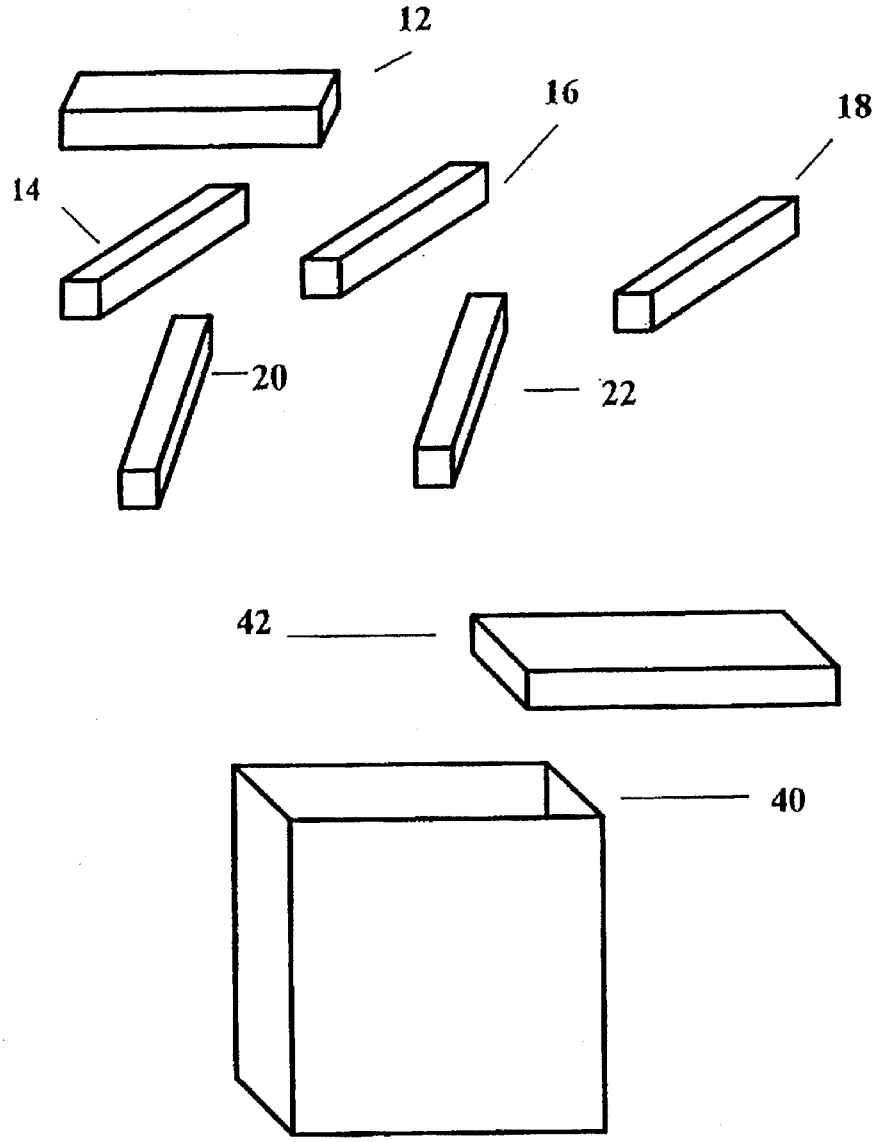
FIG. 3 is a perspective view of the present invention.
Figure 4:
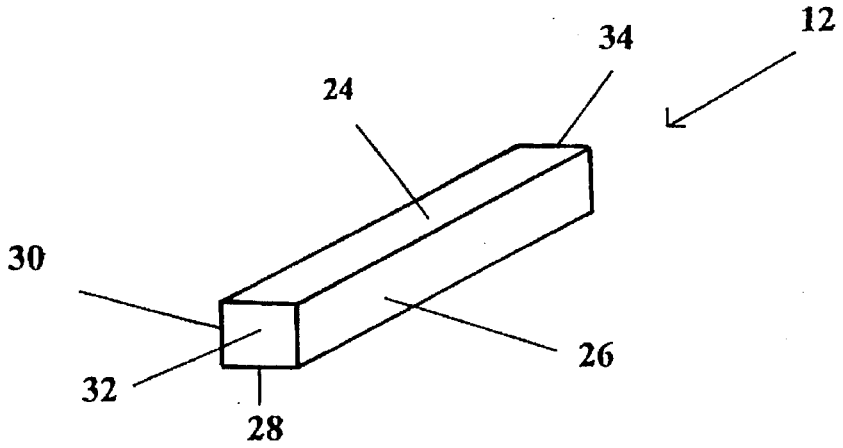
FIG. 4 is a perspective view of a stick of the present invention.
Figure 5:
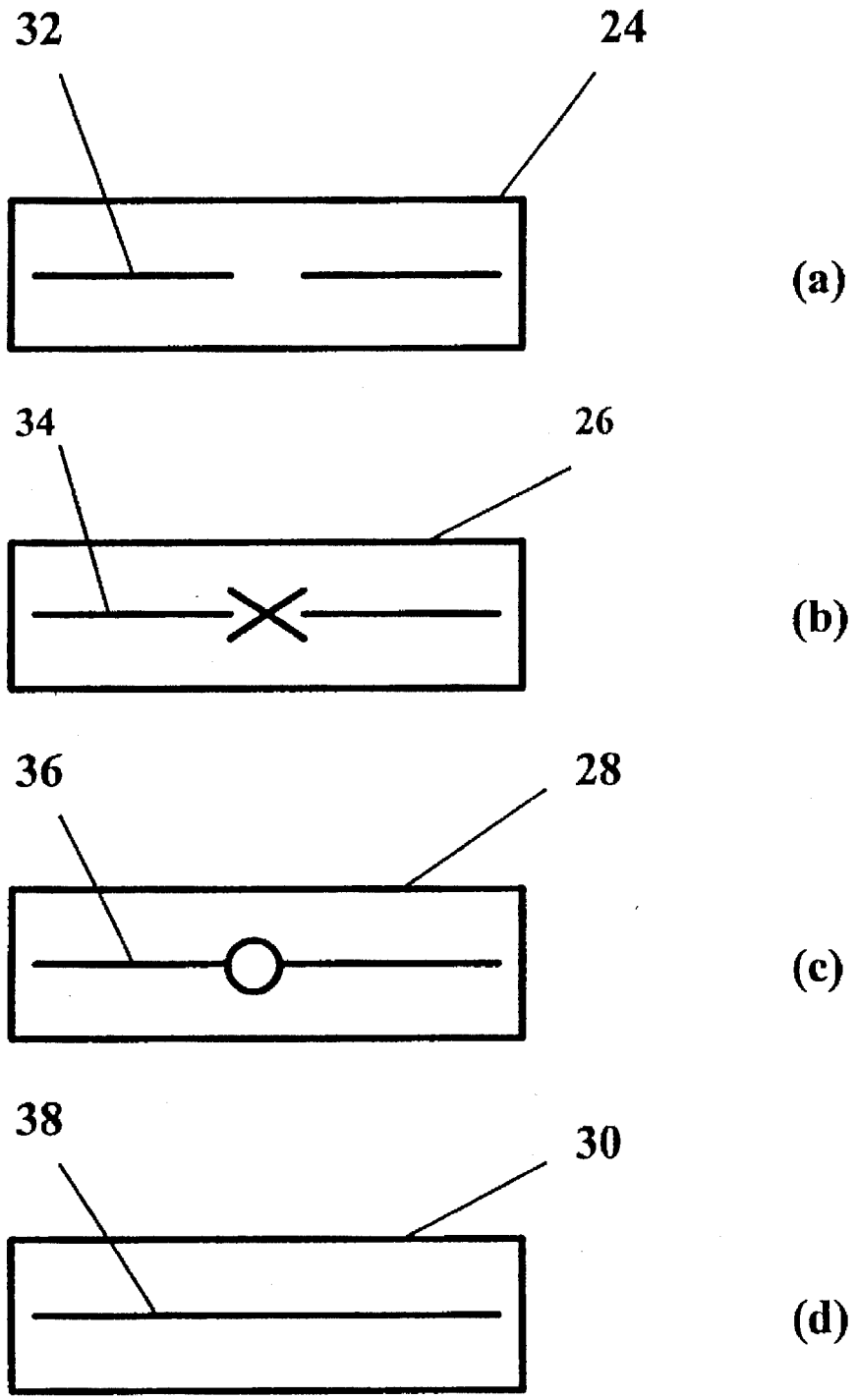
FIG. 5 is a preferred embodiment of the sticks of the present invention showing views (a–d) of the indicia provided on the sides of the sticks.

The present invention provides the six sticks 12, 14, 16, 18, 20, and 22 as shown in FIG. 3. As shown in FIG. 4, stick 12 is generally rectangular in shape and has a first side 24, a second side 26, a third side 28, a fourth side 30, a first end 32, and a second end 34. In the preferred embodiment the sticks 12–22 are identical, and as shown in FIG. 5, the first side 24 includes the Yin line 32, the second side 26 includes the changing Yin line 34, the third side 28 includes the changing Yang line 36 and the fourth side 30 includes the Yang line 38.

Regardless of the embodiment, the Yin line 32 must be opposite the changing Yang line 36 and the changing Yin line 34 must be opposite the Yang line 38.

The Book of Changes is consulted by an individual grasping the sticks 12–22 in one hand and forming the question which the individual seeks an insight. When the question is clear, the individual rolls the sticks 12–22 between both hands, places them in one palm, and then turns the sticks 12–22 over on a flat surface, such as a table. Reading the line on the top side of each stick 12–22 will provide a hexagram. Using the Book of Changes the individual may look up the Judgment, the Image and read the text of the changing lines, if any. Then the sticks having a changing line facing upward are turned over onto their opposite sides to provide the final hexagram which is then similarly used to consult the Book of Changes.

In one embodiment, the sticks 12–22 are made of wood or some other material which produces a wood-like sound when thrown on a hard flat surface. The preference of material is merely to provide an aesthetically pleasing sound.

A container 40 is provided for storing the sticks 12–22, with a cover 42 for retaining the sticks 12–22 in the container

We claim:

1. A device for consulting the Book of Changes, the device comprising:

an object, the object having a first, second, third and fourth side, the first side having a first indicia, the second side having a second indicia the third side having a third indicia and the fourth side having a fourth indicia, wherein two of the indicia represent the changing Yin line and the Yang line and are located on two of the sides opposite from one another and each having a plane parallel to one another, and the other two indicia represent the changing Yang and the Yin line and are located on the other two sides opposite one another and each having a plane parallel to one another.

2. The device of claim 1, wherein the first indicia is the Yin line, the second indicia is the changing Yin line, the third indicia is the changing Yang line and the fourth indicia is the Yang line.

3. The device of claim 1, wherein the first, second, third and fourth side each have a rectangular shape.

4. The device of claim 1, wherein the object is made of wood.

5. The device of claim 1, wherein the object has a contrasting color to the indicia.

6. A device for consulting the ancient Book of Changes, the device comprising:

six objects, each object having four longitudinally extending sides, the first side having a first indicia, the second side having a second indicia, the third side having a third indicia and a fourth side having a fourth indicia, wherein two of the indicia represent the changing Yin line and the Yang line and are located on sides opposite from one another and each having a plane parallel to one another, and the other two indicia represent the changing Yang line and the Yin line and are located on the other two sides opposite one another and each having a plane parallel to one another, whereby the six objects are tossed and the six indicia facing upward are used to construct an I-Ching hexagram.

7. The device of claim 6, wherein the first, second, third and fourth side of each of the six objects has a rectangular shape.

8. The device of claim 7, wherein the six objects are substantially the same size.

9. The device of claim 6, wherein the indicia of the first side is a Yin line, the indicia of the second side is a changing Yin line, the indicia of the third side is a changing Yang line, and the indicia of the fourth side is a Yang line.

10. The device of claim 6, wherein the objects are made of wood.

11. The device of claim 6, wherein each of the six objects is of two contrasting colors.

12. The device of claim 6, further comprising a container for storing the six objects.

13. The device of claim 12, further comprising a cover adapted for removably securing to the container for retaining the objects in the container.

14. A method of consulting the Book of Changes, the method comprising the steps of:

grasping 6 rectangular blocks each having four longitudinally extending sides with indicia, wherein two of the indicia represent the changing Yin lines and the Yang lines and are located on two of the sides opposite from one another and each having a plane parallel to one another, and the other two indicia represent the changing Yang line and the Yin line are located on the other two sides opposite from one another and each having a plane parallel to one another, tossing the six blocks so as to randomly align in a consecutive order, reading the indicia facing upwards so as to construct a hexagram, and consulting the Book of Changes for the constructed hexagram.

15. The method of claim 14, further comprising the steps of:

turning over the blocks having a changing line facing upwards so as to construct a further hexagram, and consulting the Book of Changes for the further hexagram.

16. The method of claim 14, wherein the step of tossing includes the step of manipulating the six blocks between the palms of a users hands, whereby the six blocks are aligned in a nonpredetermined orientation.

* * * * *